US010243307B2

(12) United States Patent
Ljubijankic et al.

(10) Patent No.: US 10,243,307 B2
(45) **Date of Patent: *Mar. 26, 2019**

(54) WAFER ASSEMBLY FOR ELECTRICAL CONNECTOR

(71) Applicant: Amphenol Corporation, Wallingford, CT (US)

(72) Inventors: Zlatan Ljubijankic, Mississauga (CA); Andy Toffelmire, Whitby (CA); Peter E. Jay, Toronto (CA); Barbara H. Marten, Toronto (CA); Valeria Caraiani, Thornhill (CA); Andrew B. Matus, Ajax (CA)

(73) Assignee: Amphenol Corporation, Wallingford, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/944,268

(22) Filed: Apr. 3, 2018

(65) Prior Publication Data

US 2019/0067888 A1 Feb. 28, 2019

Related U.S. Application Data

(63) Continuation-in-part of application No. 15/683,203, filed on Aug. 22, 2017, now Pat. No. 9,991,642.

(51) Int. Cl.

| | |
|---|---|
| ***H01R 12/00*** | (2006.01) |
| ***H01R 13/7197*** | (2011.01) |
| ***H01R 13/6581*** | (2011.01) |
| ***H01R 13/405*** | (2006.01) |
| ***H01R 12/71*** | (2011.01) |

(52) U.S. Cl.
CPC ..... *H01R 13/7197* (2013.01); *H01R 12/716* (2013.01); *H01R 13/405* (2013.01); *H01R 13/6581* (2013.01)

(58) Field of Classification Search
CPC .. H01R 12/727; H01R 13/6586; H01R 13/08; H01R 13/6464; H01R 13/405; H01R 43/205
USPC ..... 439/76.1, 660, 701
See application file for complete search history.

(56) References Cited

U.S. PATENT DOCUMENTS

| | | | | |
|---|---|---|---|---|
| 4,500,159 A * | 2/1985 | Briones | ..... | H01R 13/7195 439/607.01 |
| 4,726,790 A * | 2/1988 | Hadjis | ..... | H01R 13/7195 333/185 |
| 4,929,196 A * | 5/1990 | Ponn | ..... | H01R 13/7195 333/185 |

(Continued)

FOREIGN PATENT DOCUMENTS

EP 1 496 578 A1 1/2005

*Primary Examiner* — Khiem Nguyen
(74) *Attorney, Agent, or Firm* — Blank Rome LLP

(57) ABSTRACT

A wafer assembly for an electrical connector, and method for making, that has a first and second wafers configured to interlock with one another. Each of the wafers has at least one contact that has a body portion with a mating end for coupling to a mating contact and a tail end opposite the mating end for engaging a printed circuit board where the mating and tail ends extend from opposite sides of the wafer. A conductive spring member is sandwiched between the first and second wafers. The wafer assembly can include one or more electronic components in electrical contact with the spring member and one of the contacts.

20 Claims, 8 Drawing Sheets

(56) References Cited

U.S. PATENT DOCUMENTS

| | | | | |
|---|---|---|---|---|
| 5,151,054 | A * | 9/1992 | Briones | H01R 13/6582 439/620.1 |
| 5,580,280 | A * | 12/1996 | Minich | H01R 13/6625 439/620.22 |
| 5,624,277 | A * | 4/1997 | Ward | H01R 13/7195 439/620.09 |
| 7,442,085 | B2 * | 10/2008 | Fuerst | H01R 13/514 439/620.09 |
| 7,677,928 | B2 * | 3/2010 | Fuerst | H01R 13/7195 439/620.09 |
| 8,011,963 | B2 * | 9/2011 | Atkinson | H01R 13/719 439/620.09 |
| 9,325,118 | B2 * | 4/2016 | Chang | H01R 13/6466 |
| 9,362,638 | B2 * | 6/2016 | Ljubijankic | H01R 43/16 |
| 9,991,642 | B1 * | 6/2018 | Ljubijankic | H01R 13/6586 439/76.1 |
| 2002/0025719 | A1 | 2/2002 | Dingenotto et al. | |
| 2008/0020645 | A1 | 1/2008 | Fuerst et al. | |
| 2016/0064842 | A1 | 3/2016 | Ljubijankic et al. | |
| 2016/0315420 | A1 | 10/2016 | Horning et al. | |

* cited by examiner

WAFER ASSEMBLY FOR ELECTRICAL CONNECTOR

RELATED APPLICATION

This application is a continuation-in-part of and claims the benefit of application Ser. No. 15/683,203, filed Aug. 22, 2017, the subject matter of which is incorporated by reference herein.

FIELD OF THE INVENTION

The present invention relates to wafer assemblies for an electrical connector, particularly a high density connector, that are designed to enhance electrical performance.

BACKGROUND OF THE INVENTION

Electrical connectors, such as those used in the aeronautics industry, are high density and must meet certain requirements, such as those needed to meet the standards set by Airlines Electronic Engineering Committee, such as ARINC 600. One type of ARINC connector is disclosed in commonly owned U.S. Pat. No. 9,362,638 entitled Overmold Contact Wafer and Connector, the subject matter of which is incorporated by reference in its entirety.

Such high density electrical connectors, however, create interference which negatively impacts the electrical performance of the connector. Given the compact nature of high density electrical connectors, it is difficult to incorporate a mechanism for protecting against such interference, particularly for the multiple rows of contacts of such high density connectors.

Therefore, a need exists for a high density electrical connector that is designed to enhance electrical performance, particularly for connectors with multiple rows of contacts, while maintaining a compact design of the connector.

SUMMARY OF THE INVENTION

Accordingly, the present invention may provide a wafer assembly for an electrical connector, that comprises a first wafer that may comprise at least one contact that has a body portion with a mating end for coupling to a mating contact and a tail end opposite the mating end for engaging a printed circuit board and the mating and tail ends extend from opposite sides of the first wafer, and a second wafer configured to interlock with the first wafer. The second wafer may comprise at least one contact that has a body portion with a mating end for coupling to a mating contact and a tail end opposite the mating end for engaging a printed circuit board and the mating and tail ends extend from opposite sides of the second wafer. A conductive spring member is sandwiched between the first and second wafers. At least one electronic component is disposed between the first and second wafers. The at least one electronic component may be in electrical contact with the spring member and at least one of the contacts of the first or second wafer to provide at least one different electrical property to the wafer assembly.

In certain embodiments, the at least one electronic component is a voltage suppressor, a grounding chip, and/or a resistor. In some embodiments, the first and second wafers are substantially identical and the spring member is elongated to extend the length of the first and second wafers; the spring member includes at least one side spring arm in electrical contact with the at least one electronic component; each of the first and second wafers includes an overmold, each overmold includes a block section surrounding each body portion of the contacts, respectively, at least one of the block sections includes an open pocket for retaining the at least one electronic component; and/or each block section includes an alignment element that engages the spring member for proper alignment thereof between the first and second wafers.

The present invention may also provide a wafer assembly for an electrical connector, that comprises a first wafer that may comprise a plurality of first contacts, each of the first contacts having a body portion with a mating end for coupling to a mating contact and a tail end opposite the mating end for engaging a printed circuit board and the mating and tail ends extend from opposite sides of the first wafer, and a second wafer configured to interlock with the first wafer. The second wafer may comprise a plurality of second contacts. Each of the second contacts has a body portion with a mating end for coupling to a mating contact and a tail end opposite the mating end for engaging a printed circuit board and the mating and tail ends extend from opposite sides of the second wafer. A conductive spring member is sandwiched between the first and second wafers. A plurality of electronic components may be disposed between the first and second wafers. Each of the plurality of electronic components may be in electrical contact with the spring member and in electrical contact with at least one of the first contacts or second contacts to provide at least one different electrical property to the wafer assembly.

In certain embodiments, the plurality of electronic components are voltage suppressors, grounding chips, or resistors; and/or the plurality of electronic components are all the same. In other embodiments, each of the first and second wafers include an overmold and each overmold includes a plurality of block sections individually surrounding the body portions of the first and second contacts, respectively, and each block section includes an open pocket for retaining one of the plurality of electronic components; each of the first and second contacts has a surface area exposed in one of the open pockets and in contact with the one of the plurality of electronic components retained therein; the spring member is elongated to extend the length of the first and second wafers; the spring member includes a plurality of side spring arms extending therefrom, each side spring arm is in contact with one of the plurality of electronic components; and/or the spring member includes at least one end spring arm for providing a grounding path.

The present invention may further provide a method of manufacturing of a wafer assembly for an electrical connector, comprising the steps of installing a plurality of first electronic components in a first wafer such that each of the plurality of first electronic components is in electrical contact with one of a plurality of first contacts of the first wafer, each of the plurality of first electronic components being adapted to provide at least one different electrical property to the wafer assembly; loading a spring member on the first wafer; installing a plurality of second electronic components on the second wafer such that each of the plurality of second electronic components is in electrical contact with one of a plurality of second contacts of the second wafer, each of the plurality of second electronic components being adapted to provide at least one different electrical property to the wafer assembly; and interlocking the first and second wafers to form a wafer assembly such that the spring member is sandwiched in between and in electrical contact with each of the plurality of first and second electronic components.

In some embodiments of the method, the at least one different electrical property introduces to the wafer assembly one of protection against electromagnetic pulse or electro static discharge, grounding, or electrical resistance.

The present invention may yet further provide a wafer assembly for an electrical connector that comprises a first wafer comprising at least one contact that has a body portion with a mating end for coupling to a mating contact and a tail end opposite the mating end for engaging a printed circuit board and an overmold covering the body portion of the at least one contact such that the mating and tail ends extend from opposite sides of the overmold; a second wafer configured to interlock with the first wafer, the second wafer comprising at least one contact that has a body portion with a mating end for coupling to a mating contact and a tail end opposite the mating end for engaging a printed circuit board and an overmold covering the body portion of the at least one contact such that the mating and tail ends extend from opposite sides of the overmold; and an elongated spring member sandwiched between the first and second wafers, the elongated spring member being conductive.

In one embodiment, the first and second wafers are substantially identical and the elongated spring member extends the length of the first and second wafers. Also in a certain embodiment, the wafer assembly may further comprising at least one filter component disposed between the first and second wafers wherein the at least one filter component is in electrical contact with the elongated spring member and at least one of the contacts of the first or second wafer for suppressing electrical interference. In a preferred embodiment, the filter component is a capacitor chip.

In some embodiments, the overmold of each of the first and second wafers includes a block section surrounding each body portion of the contacts, respectively, and at least one of the block sections includes an open pocket for retaining the at least one filter component; the elongated spring member includes at least one side spring arm in electrical contact with the at least one filter component; at least one of the block sections includes an open pocket for retaining the at least one filter component, and the at least one block section includes a ramp adjacent the open pocket for accommodating the at one side spring arm; each block section includes an alignment element that engages the elongated spring member for proper alignment and retention thereof between the first and second wafers; the alignment element is a protrusion that is received in a corresponding hole of the elongated spring member; and the elongated spring member includes at least one end spring arm for providing a grounding path.

The present invention also provides a wafer assembly for an electrical connector that comprises a first wafer comprising a plurality of first contacts, each of the first contacts having a body portion with a mating end for coupling to a mating contact and a tail end opposite the mating end for engaging a printed circuit board and an overmold covering the body portions of the first contacts such that the mating and tail ends extend from opposite sides of the overmold; a second wafer configured to interlock with the first wafer, the second wafer comprising a plurality of second contacts, each of the second contacts having a body portion with a mating end for coupling to a mating contact and a tail end opposite the mating end for engaging a printed circuit board and an overmold covering the body portions of the second contacts such that the mating and tail ends extend from opposite sides of the overmold; an elongated spring member sandwiched between the first and second wafers, the elongated spring member being conductive; and a plurality of filter components disposed between the first and second wafers, each of the plurality of filter components being in electrical contact with the elongated spring member and in electrical contact with at least one of the first contacts or second contacts. In a preferred embodiment, each of the plurality of filter components is a capacitor chip.

In certain embodiments, each overmold of the first and second wafers includes a plurality of block sections individually surrounding the body portions of the first and second contacts, respectively, and each block section includes an open pocket for retaining one of the plurality of filter components; each overmold includes an alignment element located on one of the block sections thereof, and each alignment element is adapted to engage the elongated spring member for proper alignment and retention thereof between the first and second wafers; each of the alignment elements is a protrusion that is received in a corresponding hole in the elongated spring member; and each overmold has connecting pieces wherein each connecting pieces extends between two of the block sections thereof, and each connecting piece is configured to accommodate one of the block sections of the other overmold.

In other embodiments, each of the first and second contacts has a surface area exposed in one of the open pockets of the block sections and in contact with the one of the plurality of filter components retained therein; the elongated spring member includes a plurality of side spring arms extending therefrom wherein each side spring arm is in contact with one of the plurality of filter components; the plurality of side spring arms alternate between extending in opposite directions; and the elongated spring member includes at least one end spring arm for providing a grounding path.

The present invention may further provide a method of manufacturing of a wafer assembly for an electrical connector, comprising the steps of forming a first wafer by providing a plurality of first contacts, each first contact including a body portion, a mating end, and a tail end, and applying an overmold to the body portions of the first contacts; installing a plurality of first filter components on the overmold of the first wafer such that each of the plurality of first filter components is in electrical contact with one of the plurality of first contacts, each of the plurality of first filter components being adapted to suppress electrical interference; loading an elongated spring member on the overmold of the first wafer; forming a second wafer by providing a plurality of second contacts, each second contact including a body portion, a mating end, and a tail end, and applying an overmold to the body portions of the second contacts; installing a plurality of second filter components on the overmold of the second wafer such that each of the plurality of second filter components is in electrical contact with one of the plurality of second contacts, each of the plurality of second filter components being adapted to suppress electrical interference; and interlocking the first and second wafers to form a wafer assembly such that the elongated spring member is sandwiched in between and in electrical contact with each of the first and second filter components.

In a preferred embodiment, the method further comprises the step of electrically connecting each of a plurality of side spring arms extending from the elongated spring member with one of the first and second filter components. In some embodiments, the method further comprises the steps of providing a grounding path to the wafer assembly through an end spring arm extending from an end of the elongated spring member; aligning the elongated spring member with the overmold of the first wafer by engaging alignment protrusions of the overmold of the first wafer with corresponding holes in the elongated spring member; and/or aligning the overmolds of the first and second wafers by engaging the alignments protrusions of one of the overmolds with alignment holes of the other of the overmolds.

With those and other objects, advantages, and features of the invention that may become hereinafter apparent, the nature of the invention may be more clearly understood by reference to the following detailed description of the invention, the appended claims, and the several drawings attached herein.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
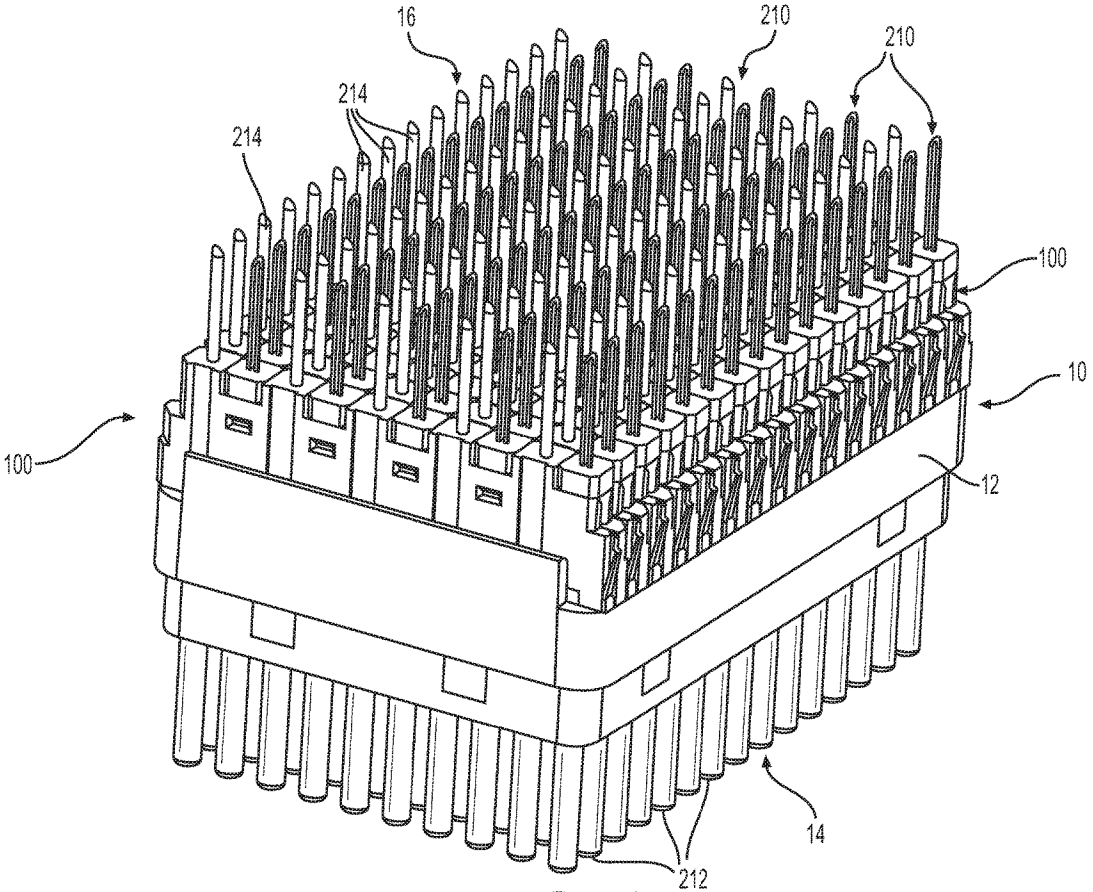
FIG. 1 is a perspective view of an electrical connector populated with wafer assemblies according to an exemplary embodiment of the present invention.

Referring to the figures, the present invention relates to a wafer assembly 100, 100' for an electrical connector 10, such as a high density ARINC-type connector. The connector 10 preferably includes a housing 12 that is adapted to receive a plurality of the wafer assemblies 100, as seen in FIG. 1. The housing 12 has one side 14 that interfaces with a mating connector and another side 16 opposite thereof that faces the printed circuit board. The wafer assemblies 100, 100' of connector 10 are configured to couple with the mating connector at one end and with the printed circuit board at the other end, thereby electrically connecting the mating connector to the circuit board. In one embodiment, each wafer assembly 100 is designed to suppress interference that may negatively impact the electrical performance of the electrical connector 10, such as electromagnetic and radio frequency interference. In another embodiment, each wafer assembly 100' is designed to enhance electrical performance by achieving different electrical properties of the assembly, such as by providing protecting against electromagnetic pulse or electro static discharge (or the like), grounding, or electrical resistance.

Figure 3:
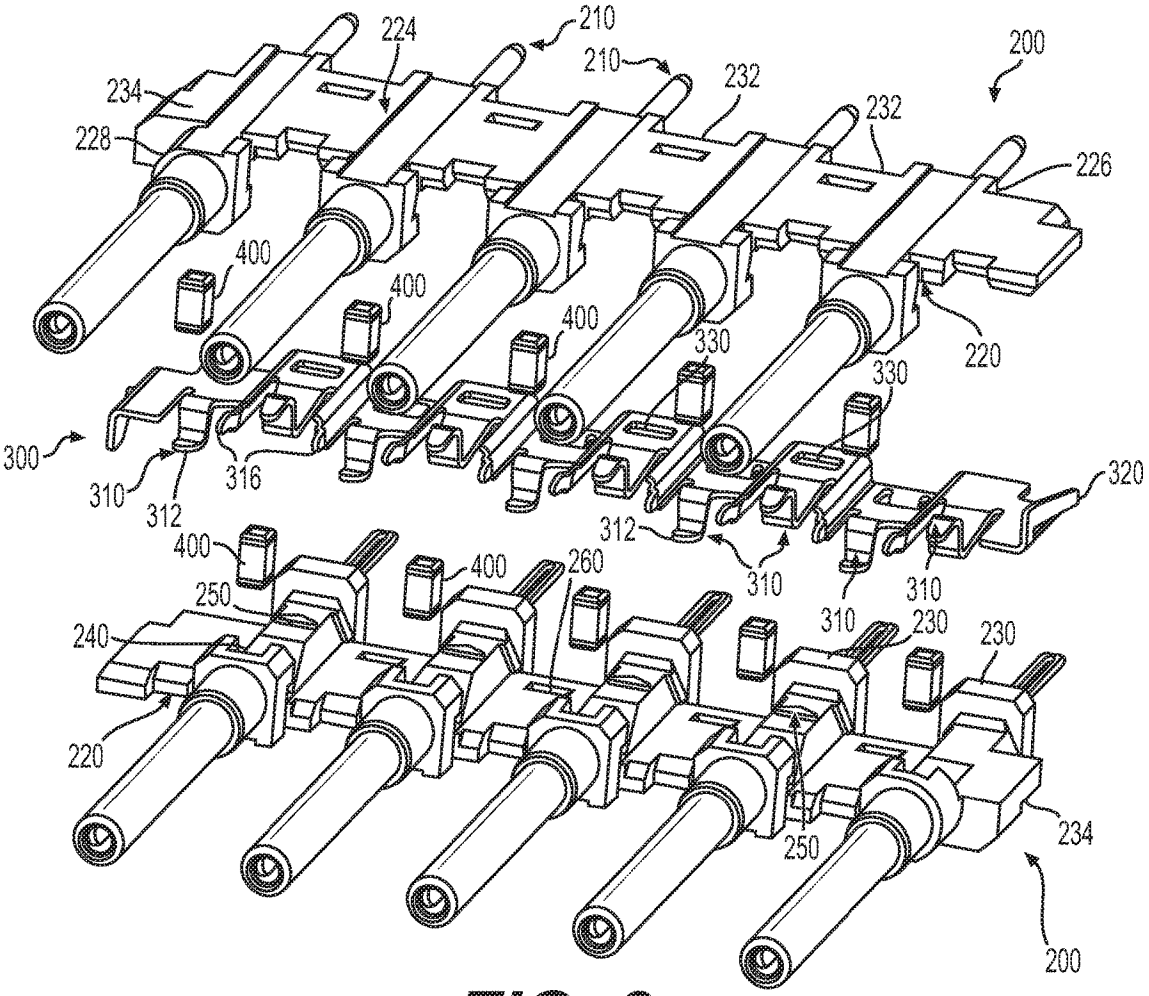
FIG. 3 is an exploded perspective view of one of the wafer assemblies illustrated in FIG. 1.
Figure 6A:
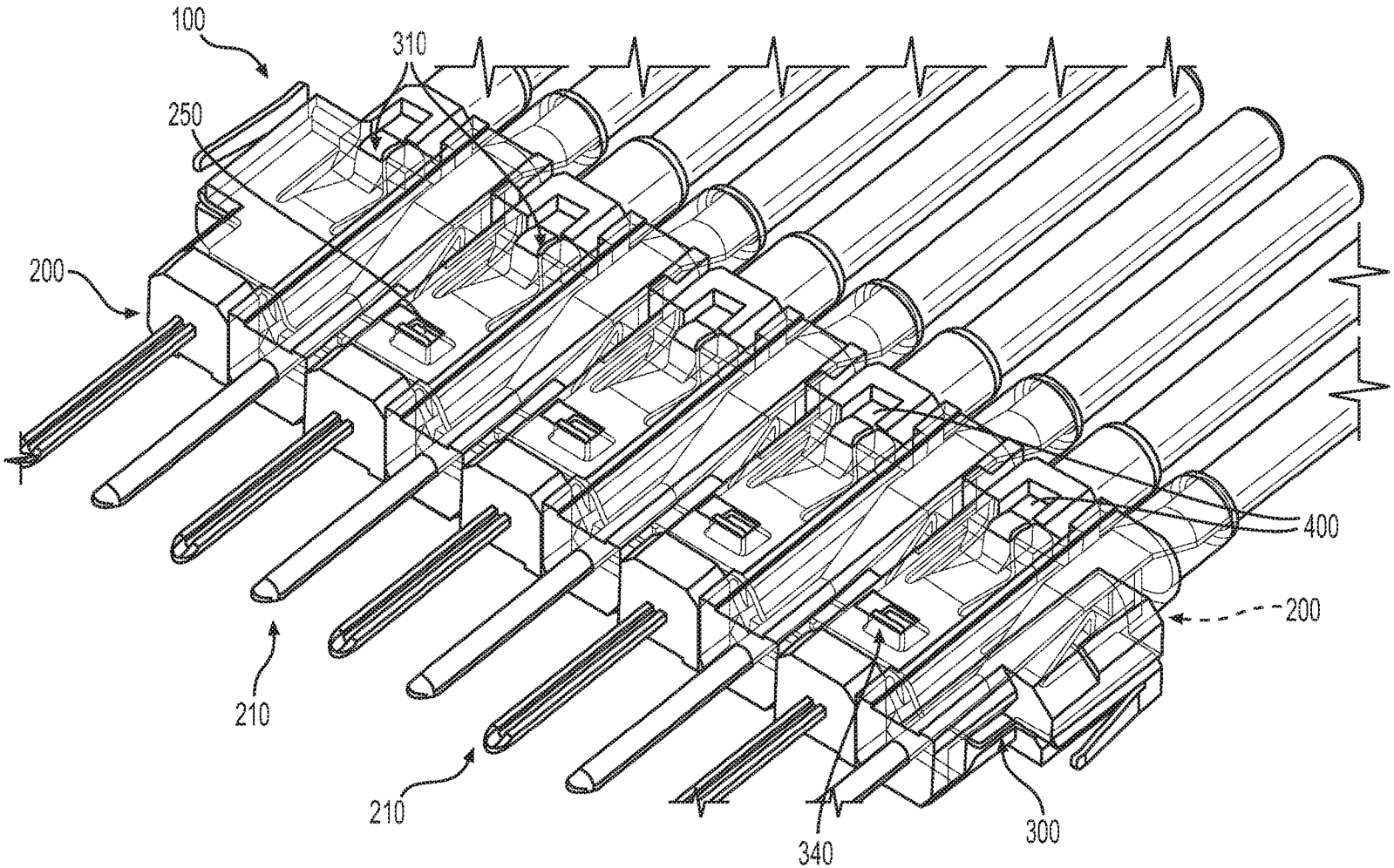
FIGS. 6A and 6B are an enlarged partial perspective views of the wafer assembly illustrated in FIG. 3, showing the wafers interlocked and showing the top wafer in phantom in FIG. 6A for clarity.
Figure 6B:
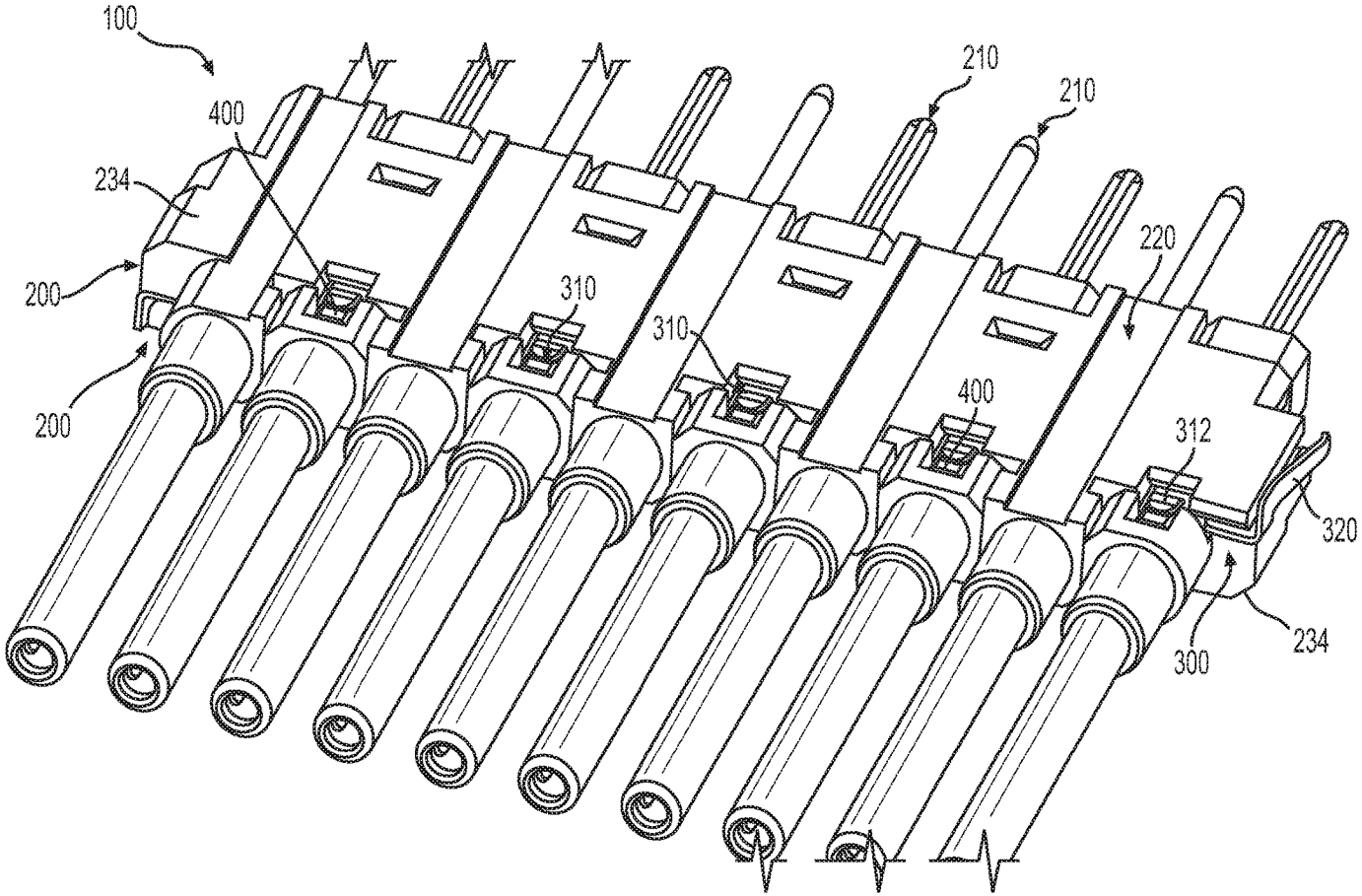

In one embodiment, each wafer assembly 100 is formed by interlocking two wafers 200 with a spring member 300 and one or more filter components 400 therebetween, as illustrated in FIGS. 3, 6A, and 6B. Each of the one or more filter components 400 is positioned to be in electrical contact with both the spring member 300 and with each contact 210 of the wafers 200. In another embodiment, wafer assembly 100' is similar to wafer assembly 100, except that it includes one or more electronic components 400' (instead of filter components 400) between the wafers 200, as seen in FIG. 7.

Figure 2:
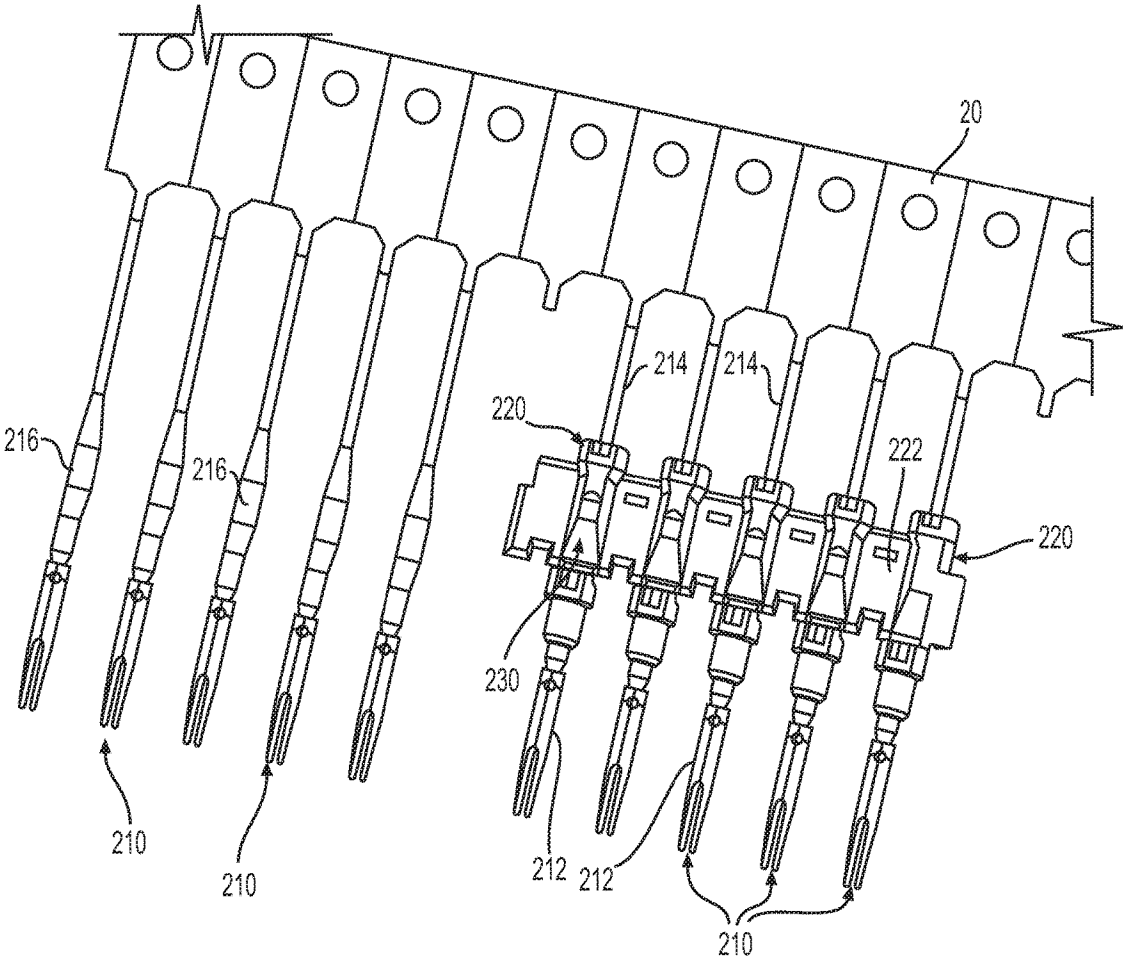
FIG. 2 is a perspective view of a plurality of contacts of an exemplary embodiment of the present invention, showing a group of the contacts with an overmold to form a wafer.

Each wafer 200 of the exemplary embodiments includes a plurality of the contacts 210 held together by an overmold 220, such as by overmolding a group of the contacts 210 to create the overmold 220 over the contacts, as seen in FIG. 2. Each contact 210 includes a mating end 212, an opposite tail end 214, and a body portion 216 (FIG. 2) therebetween. The ends 212 and 214 of each contact 210 are exposed at either side of the overmold 220. The mating ends 212 are adapted to engage the mating contact and the tail ends 214 are adapted to engage the printed circuit board, such as by soldering or press fit. In an embodiment, the wafers 200 are substantially identical.

The overmold 220 of each wafer 200 is preferably a unitary one-piece member that includes opposite sides 222 and 224 and opposite ends 226 and 228. The first side 222 includes a block section 230 for each body portion 216 of each contact 210 and a connecting piece 232 between each block section 230. Each connecting piece 232 of one wafer is designed to accept a corresponding block section 230 of the other overmold when interlocking the wafers 200, as seen in FIGS. 6A and 6B. And when the two wafers 200 are interlocked, the contacts 210 thereof alternate and are preferably in axial and longitudinally alignment. That is, the mating ends 212 of the contacts 210 of both wafers 200 may be aligned and likewise the tail ends 214 of the contacts 210 of both wafers 200 may be aligned, as seen in FIG. 1. The opposite second side 224 of each overmold 220 may be substantially flat. Each overmold 220 may include end extension 234 extending from one of its ends 226 or 228 that covers an end of spring member 300 and facilitates clamping of the wafer assemblies 100 and housing 12 into a shell.

Figure 4:
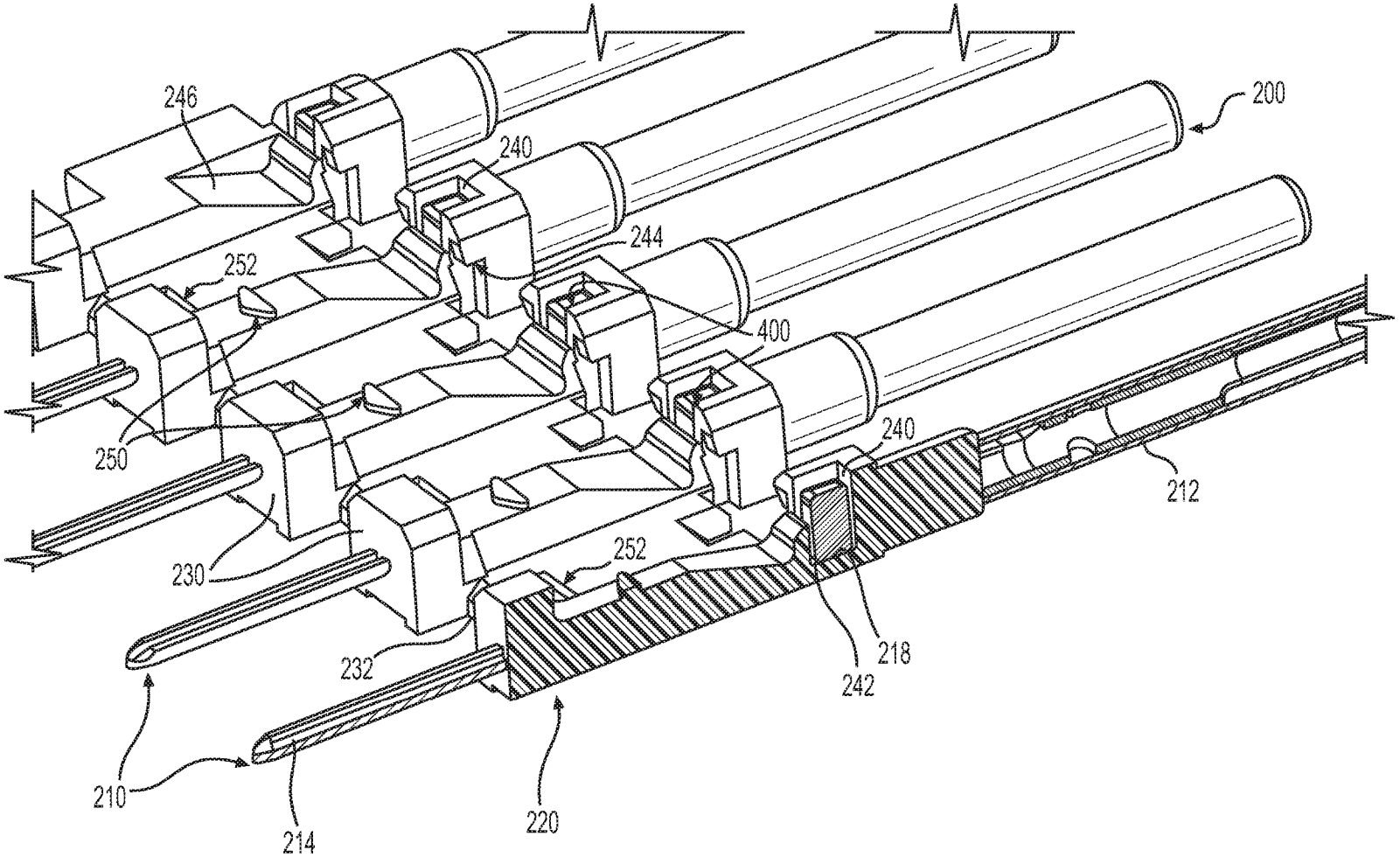
FIG. 4 is an enlarged partial perspective view of a wafer of the wafer assembly illustrated in FIG. 3, showing the wafer loaded with filter components.
Figure 5:
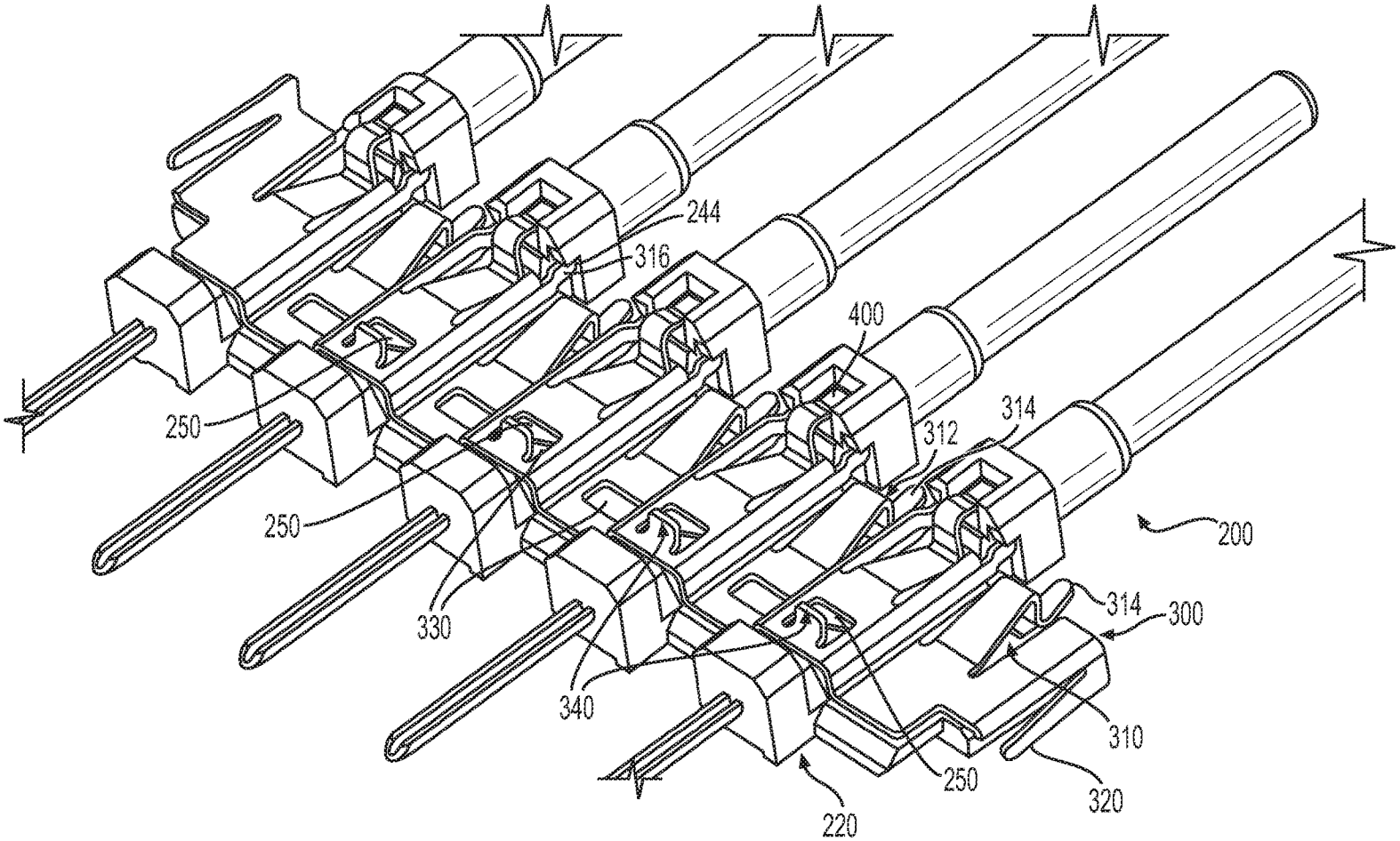
FIG. 5 is another enlarged partial perspective view of the wafers illustrated in FIG. 4, showing the wafer loaded with a spring member.
Figure 7:
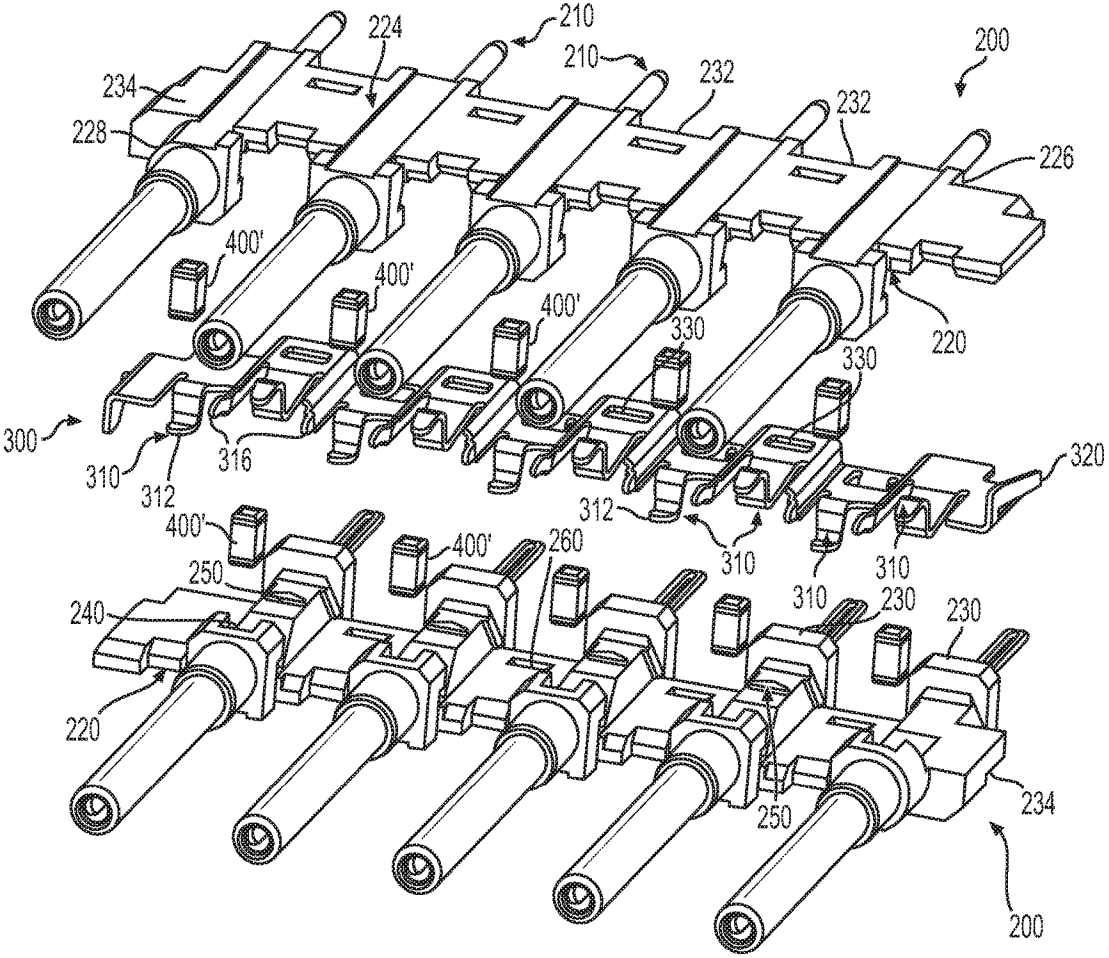
FIG. 7 is an exploded perspective view of a wafer assembly according to another exemplary embodiment of the present invention.

As seen in FIGS. 4 and 5, each block section 230 of each overmold 220 may include an open pocket 240 sized to retain one of the filter components 400 (FIG. 3) or one of the electronic components 400' (FIG. 7). Filter components 400, may be, for example, capacitor chips or the like. Electronic components 400' may be any electronic component that provides a different electrical property to or changes an electrical property of the wafer assembly and ultimately the connector. For example, the electronic components 400' may be voltage suppressors, such as diodes, varistors, thyristors, or the like, used for protection against electromagnetic pulse, electro static discharge, and the like. The electronic components 400' may also be resistors used to reduce current flow, adjust signal levels, match impedance, divide voltages, terminate transmission lines, or the like. The benefit of terminating lines with resistors reduces reflections of high frequency signals, such as in a differential cable pair. Or the electronic components 400' may be grounding chip used for grounding lines. The electronic components 400' may all be the same type or may be a mix of the above.

Each pocket 240 preferably has an open bottom 242 that exposes a surface 218 (FIG. 4) of each contact 210 for electrical contact with the filter component 400 or electronic component 400' retained in the pocket 240. Each wafer overmold 220 may include an alignment mechanism for aligning and retaining spring member 300 therebetween when the wafers 200 are interlocked. This mechanism may be an alignment element 250 provided on each block section 230 that engages with a corresponding element of spring member 300 to align and retain the same. As seen in FIG. 5, the alignment element 250, which may be, for example, a protrusion, pin or the like, is preferably spaced from the open pocket 240 of each block section 230.

The spring member 300 is conductive and preferably elongated with respect to the longitudinal length of each wafer 200 such that spring member 300 generally extends from one end 226 of each wafer 200 to the other end 228. Spring member 300 may have a generally corrugated shape to accommodate the general size and shape of the block sections 230 and the connecting pieces 232, respectively, of the overmolds of each wafer 200. Spring member 300 may include one more side spring arms 310 extending from a longitudinal side of the spring member 300. In a preferred embodiment, the number of spring arms 310 correspond to the number of filter components 400 or electronic components 400' and each spring arm 310 is in contact with one of the filter components 400 or electronic components 400' of each wafer to provide an electrical connection therebetween. A free end 312 of each side spring arm 310 may have a generally S-shape and an end face 314 thereof abuts against a surface of the filter component 400 or electronic components 400'. As best seen in FIGS. 3 and 7, the free ends 312 of the side spring arms 310 alternatively extend in opposite directions to contact the filter components 400 or electronic components 400' of each respective wafer. Each block section 230 of the wafer overmolds 220 may include a ramp 246 that is adjacent to its open pocket 240 to accommodate each free end 312 of each side spring arm 310.

A stabilizing tab 316 may be provided near or adjacent to each spring arm 310. The stabilizing tab 316 may engage the overmold 220 of the wafers to help stabilize the spring member 330 and eliminate large tilt and reaction force upon installation of spring member 300 onto wafer 200. The stabilizing tab 316 may, for example, extend under a ledge portion 244 of the wafer's block section 230, as seen in FIG. 5, to stabilize the spring member 300 with respect to the wafer 200. The spring member 300 may also have at least one end spring arm 320 at either end of the spring member for providing a grounding path through the connector, as seen in FIG. 1. The grounding spring arm 320 preferably extends in a direction opposite to the side spring arms 310.

Spring member 300 may have one more alignment elements 330 that correspond to the alignment elements 250 of each wafer 200. The alignment elements 330 of the spring member 300 may be, for example, holes or the like, are designed to receive the alignment elements 250 of each wafer 200 when the wafers 200 are interlocked to form the wafer assembly 100. An optional additional alignment element 252, such as a hole or the like (FIG. 4), may be provided on the connecting pieces 232 of each wafer 200 such the additional alignment elements 252 of the connecting pieces 232 of one wafer 200 engage the alignment elements 250 of the block sections 230 of the other wafer 200 when the two wafers are interlocked to form the wafer assembly 100. Alternatively, the alignment elements 330 of spring member 300 may be protrusions and the wafer alignment elements 250 may be holes size to accommodate the protrusions.

Spring member 300 may also include one or more locating tabs 340 that extend generally normal to the spring member 300. Each locating tab 340 is adapted to engage the second wafer of the wafer assembly 100. For example, each locking tab 340 may be inserted into a corresponding slot 260 in the connecting pieces 232 of the overmold of the second wafer.

A method of manufacturing the wafer assembly 100, 100' according to the present includes the step of forming each of two wafers 200 by overmolding a group of the contacts 210, as seen in FIG. 2, to form the overmold 220 that surrounds the body portions 216 of each of the contacts 210. The contacts 210 themselves may be formed, for example, by stamping them from a metal sheet and then removing the carrier strip 20 (preferably after the overmolding step). Once the overmold 220 is formed for each wafer 200, then the filter components 400 or electronic components 400' may be installed in each wafer 200 by placing one filter component 400 or one electronic component 400' in each pocket 240 of each overmold block section 230 of each wafer 200 such that a surface of each filter component 400 or electronic component 400' contacts the exposed surface 218 of each contact 210, respectively, to create an electrical connection therebetween.

The spring member 300 may then be loaded onto one of the wafers 200. The spring member 300 may be loaded by placing the spring member 300 on the block sections 230 and connecting pieces 232 of the selected wafer, such that each of the alignment protrusions 250 of the wafer engages a corresponding hole 330 of the spring member. When the spring member 300 is loaded, each of the free ends 312 of its side spring arms 310 contact a surface of each of the filter components 400 or electronic components 400' installed in the selected wafer 200, such that an electrical connection is created therebetween. Once the spring member 300 is installed on one of the wafers, the two wafers may then be interlocked with one another that the connecting pieces 232 of each wafer accepts a corresponding block section 230 of the other wafer, thereby forming the wafer assembly 100. The wafers 200 are preferably designed to form a press-fit therebetween when interlocked. Other known engagements, such as a latch or the like, may be used to secure the wafers together.

The wafer assembly 100 can then be installed into the housing 12 from the printed circuit board side 14 of the housing. The bottom of the overmold 220 of each wafer 200 may abut the housing 12 to prevent the wafer assembly 100 from being inserted too far into the housing. Once installed in the housing 110, the contact mating ends 212 are exposed at one side and ready to engage a mating component and the contact tail ends 214 are exposed at the other side and ready to engage a printed circuit board. A plurality of wafer assemblies 100 can be likewise installed in the housing 12 to form the connector 10, as seen in FIG. 1. An electrical path is created through each filter component 400 or electronic component 400' of each wafer assembly 100 to suppress interference and enhance the electrical performance of the connector 10. Additionally, each wafer provides a grounding path for the connector 10 through the end spring arms of each spring member 300 of each wafer 200.

Although certain presently preferred embodiments of the disclosed invention have been specifically described herein, it will be apparent to those skilled in the art to which the invention pertains that variations and modifications of the various embodiments shown and described herein may be made without departing from the spirit and scope of the invention. Accordingly, it is intended that the invention be limited only to the extent required by the appended claims and the applicable rules of law.

What is claimed is:

1. A wafer assembly for an electrical connector, comprising:

a first wafer comprising at least one contact that has a body portion with a mating end for coupling to a mating contact and a tail end opposite the mating end for engaging a printed circuit board and the mating and tail ends extend from opposite sides of the first wafer;

a second wafer configured to interlock with the first wafer, the second wafer comprising at least one contact that has a body portion with a mating end for coupling to a mating contact and a tail end opposite the mating end for engaging a printed circuit board and the mating and tail ends extend from opposite sides of the second wafer;

a conductive spring member sandwiched between the first and second wafers; and at least one electronic component disposed between the first and second wafers, the at least one electronic component being in electrical contact with the spring member and at least one of the contacts of the first or second wafer to provide at least one different electrical property to the wafer assembly.

2. The wafer assembly of claim 1, wherein the at least one electronic component is a voltage suppressor.

3. The wafer assembly of claim 1, wherein the at least one electronic component is a grounding chip.

4. The wafer assembly of claim 1, wherein the at least one electronic component is a resistor.

5. The wafer assembly of claim 1, wherein the first and second wafers are substantially identical and the spring member is elongated to extend the length of the first and second wafers.

6. The wafer assembly of claim 1, wherein the spring member includes at least one side spring arm in electrical contact with the at least one electronic component.

7. The wafer assembly of claim 1, wherein each of the first and second wafers includes an overmold, each overmold includes a block section surrounding each body portion of the contacts, respectively, at least one of the block sections includes an open pocket for retaining the at least one electronic component.

8. The wafer assembly of claim 7, wherein each block section includes an alignment element that engages the spring member for proper alignment thereof between the first and second wafers.

9. A wafer assembly for an electrical connector, comprising:

a first wafer comprising a plurality of first contacts, each of the first contacts having a body portion with a mating end for coupling to a mating contact and a tail end opposite the mating end for engaging a printed circuit board and the mating and tail ends extend from opposite sides of the first wafer;

a second wafer configured to interlock with the first wafer, the second wafer comprising a plurality of second contacts, each of the second contacts having a body portion with a mating end for coupling to a mating contact and a tail end opposite the mating end for engaging a printed circuit board and the mating and tail ends extend from opposite sides of the second wafer;

a conductive spring member sandwiched between the first and second wafers; and a plurality of electronic components disposed between the first and second wafers, each of the plurality of electronic components being in electrical contact with the spring member and in electrical contact with at least one of the first contacts or second contacts to provide at least one different electrical property to the wafer assembly.

10. The wafer assembly of claim 9, wherein each of the plurality of electronic components is a voltage suppressor.

11. The wafer assembly of claim 9, wherein each of the electronic components is a grounding chip.

12. The wafer assembly of claim 9, wherein each of the plurality of electronic components is a resistor.

13. The wafer assembly of claim 9, wherein the plurality of electronic components are all the same.

14. The wafer assembly of claim 9, wherein each of the first and second wafers includes an overmold, each overmold includes a plurality of block sections individually surrounding the body portions of the first and second contacts, respectively, and each block section includes an open pocket for retaining one of the plurality of electronic components.

15. The wafer assembly of claim 14, wherein each of the first and second contacts has a surface area exposed in one of the open pockets and in contact with the one of the plurality of electronic components retained therein.

16. The wafer assembly of claim 9, wherein the spring member is elongated to extend the length of the first and second wafers.

17. The wafer assembly of claim 16, wherein the spring member includes a plurality of side spring arms extending therefrom, each side spring arm is in contact with one of the plurality of electronic components.

18. The wafer assembly of claim 17, wherein the spring member includes at least one end spring arm for providing a grounding path.

19. A method of manufacturing of a wafer assembly for an electrical connector, comprising the steps of:

installing a plurality of first electronic components in a first wafer such that each of the plurality of first electronic components is in electrical contact with one of a plurality of first contacts of the first wafer, each of the plurality of first electronic components being adapted to provide at least one different electrical property to the wafer assembly;

loading a spring member on the first wafer;

installing a plurality of second electronic components on the second wafer such that each of the plurality of second electronic components is in electrical contact with one of a plurality of second contacts of the second wafer, each of the plurality of second electronic components being adapted to provide at least one different electrical property to the wafer assembly; and interlocking the first and second wafers to form a wafer assembly such that the spring member is sandwiched in between and in electrical contact with each of the plurality of first and second electronic components.

20. A method according to claim 19, wherein the at least one different electrical property introduces to the wafer assembly one of protection against electromagnetic pulse or electro static discharge, grounding, or electrical resistance.

* * * * *